US009805738B2

(12) United States Patent
Krini et al.

(10) Patent No.: US 9,805,738 B2
(45) Date of Patent: Oct. 31, 2017

(54) FORMANT DEPENDENT SPEECH SIGNAL ENHANCEMENT

(75) Inventors: Mohamed Krini, Ulm (DE); Ingo Schalk-Schupp, Gunzburg (DE); Markus Buck, Biberach (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 0 days.

(21) Appl. No.: 14/423,543

(22) PCT Filed: Sep. 4, 2012

(86) PCT No.: PCT/US2012/053666

§ 371 (c)(1),
(2), (4) Date: Aug. 31, 2015

(87) PCT Pub. No.: WO2014/039028

PCT Pub. Date: Mar. 13, 2014

(65) Prior Publication Data

US 2016/0035370 A1 Feb. 4, 2016

(51) Int. Cl.

*G10L 21/00* (2013.01)
*G10L 25/18* (2013.01)
(Continued)

(52) U.S. Cl.

CPC ..... *G10L 25/18* (2013.01); *G10L 19/06* (2013.01); *G10L 21/02* (2013.01); *G10L 21/0232* (2013.01); *G10L 2019/0016* (2013.01)

(58) Field of Classification Search

CPC ..... G10L 25/48; G10L 21/0208; G10L 25/00; G10L 25/15; G10L 15/187;
(Continued)

(56) References Cited

U.S. PATENT DOCUMENTS 4,015,088 A 3/1977 Dubnowski et al.
4,052,568 A 10/1977 Jankowski
(Continued)

FOREIGN PATENT DOCUMENTS

CN 101350108 A 1/2009
CN 102035562 A 4/2011
(Continued)

OTHER PUBLICATIONS

Chinese Patent Application; date of entry Apr. 9, 2015; for Chinese Pat. App. No. 201280076334.6; 39 pages.
(Continued)

*Primary Examiner* — Michael Colucci
(74) *Attorney, Agent, or Firm* — Daly, Crowley, Mofford & Durkee, LLP

(57) ABSTRACT

An arrangement is described for speech signal processing. An input microphone signal is received that includes a speech signal component and a noise component. The microphone signal is transformed into a frequency domain set of short-term spectra signals. Then speech formant components within the spectra signals are estimated based on detecting regions of high energy density in the spectra signals. One or more dynamically adjusted gain factors are applied to the spectra signals to enhance the speech formant components.

21 Claims, 7 Drawing Sheets

(51) Int. Cl.

| | |
|---|---|
| ***G10L 21/02*** | (2013.01) |
| ***G10L 19/06*** | (2013.01) |
| ***G10L 21/0232*** | (2013.01) |
| *G10L 19/00* | (2013.01) |

(58) Field of Classification Search

CPC ..... G10H 2250/481; G10H 2250/485; G10H 2250/491; G10H 2250/501

USPC ..... 704/209, 206, 207, 214, 216, 219, 222, 704/225, 226, 231, 233, 237; 381/318, 381/320, 71.1; 84/610

See application file for complete search history.

(56) References Cited

U.S. PATENT DOCUMENTS 4,057,690 A 11/1977 Vagliani et al.
4,359,064 A 11/1982 Kimble
4,410,763 A 10/1983 Strawczynski et al.
4,536,844 A * 8/1985 Lyon ..... G10L 25/00 381/320
4,672,669 A 6/1987 DesBlache et al.
4,688,256 A 8/1987 Yasunaga
4,764,966 A 8/1988 Einkauf et al.
4,825,384 A 4/1989 Sakurai
4,829,578 A 5/1989 Roberts
4,864,608 A 9/1989 Miyamoto et al.
4,914,692 A 4/1990 Hartwell et al.
5,034,984 A 7/1991 Bose
5,048,080 A 9/1991 Bell et al.
5,125,024 A 6/1992 Gokcen et al.
5,155,760 A 10/1992 Johnson et al.
5,220,595 A 6/1993 Uehara
5,239,574 A 8/1993 Brandman et al.
5,349,636 A 9/1994 Irribarren
5,394,461 A 2/1995 Garland
5,416,887 A 5/1995 Shimada
5,434,916 A 7/1995 Hasegawa
5,475,791 A 12/1995 Schalk et al.
5,574,824 A 11/1996 Slyh et al.
5,577,097 A 11/1996 Meek
5,581,620 A 12/1996 Brandstein et al.
5,581,652 A * 12/1996 Abe ..... G10L 21/038 704/220
5,602,962 A 2/1997 Kellermann
5,627,334 A * 5/1997 Hirano ..... G10H 7/105 84/623
5,652,828 A 7/1997 Silverman
5,696,873 A * 12/1997 Bartkowiak ..... G10L 25/90 704/207
5,708,704 A 1/1998 Fisher
5,708,754 A 1/1998 Wynn
5,721,771 A 2/1998 Higuchi et al.
5,744,741 A * 4/1998 Nakajima ..... G10H 1/125 84/622
5,761,638 A 6/1998 Knittle et al.
5,765,130 A 6/1998 Nguyen
5,784,484 A 7/1998 Umezawa
5,799,276 A * 8/1998 Komissarchik ..... G10L 15/04 704/207
5,939,654 A * 8/1999 Anada ..... G09B 15/002 434/307 A
5,959,675 A 9/1999 Mita et al.
5,978,763 A 11/1999 Bridges
6,009,394 A * 12/1999 Bargar ..... G06F 3/011 381/17
6,018,711 A 1/2000 French-St. George et al.
6,061,651 A 5/2000 Nguyen
6,098,043 A 8/2000 Forest et al.
6,246,986 B1 6/2001 Ammicht et al.
6,253,175 B1 * 6/2001 Basu ..... G10L 15/02 704/231
6,266,398 B1 7/2001 Nguyen
6,279,017 B1 8/2001 Walker
6,353,671 B1 * 3/2002 Kandel ..... H04R 25/453 381/312
6,373,953 B1 4/2002 Flaks
6,449,593 B1 9/2002 Valve
6,496,581 B1 12/2002 Finn et al.
6,526,382 B1 2/2003 Yuschik
6,549,629 B2 4/2003 Finn et al.
6,574,595 B1 6/2003 Mitchell et al.
6,636,156 B2 10/2003 Damiani et al.
6,647,363 B2 11/2003 Claassen
6,717,991 B1 4/2004 Gustafsson et al.
6,778,791 B2 8/2004 Shimizu et al.
6,785,365 B2 8/2004 Nguyen
6,898,566 B1 * 5/2005 Benyassine ..... G10L 19/22 704/207
7,065,486 B1 6/2006 Thyssen
7,068,796 B2 6/2006 Moorer
7,069,213 B2 6/2006 Thompson
7,069,221 B2 6/2006 Crane et al.
7,117,145 B1 10/2006 Venkatesh et al.
7,162,421 B1 1/2007 Zeppenfeld et al.
7,171,003 B1 1/2007 Venkatesh et al.
7,206,418 B2 4/2007 Yang et al.
7,224,809 B2 5/2007 Hoetzel
7,274,794 B1 9/2007 Rasmussen
7,424,430 B2 * 9/2008 Kawahara ..... G10H 7/10 704/268
7,643,641 B2 1/2010 Haulick et al.
8,000,971 B2 8/2011 Ljolje
8,050,914 B2 11/2011 Schmidt et al.
8,831,942 B1 * 9/2014 Nucci ..... G10L 17/26 704/207
8,990,081 B2 * 3/2015 Lu ..... G10L 15/02 381/316
2001/0038698 A1 11/2001 Breed et al.
2002/0138253 A1 * 9/2002 Kagoshima ..... G10L 13/04 704/207
2002/0184031 A1 12/2002 Brittan et al.
2003/0026437 A1 2/2003 Janse et al.
2003/0065506 A1 * 4/2003 Adut ..... G10L 19/18 704/207
2003/0072461 A1 4/2003 Moorer
2003/0088417 A1 * 5/2003 Kamai ..... G10L 19/04 704/258
2003/0185410 A1 10/2003 June et al.
2004/0047464 A1 3/2004 Yu et al.
2004/0076302 A1 4/2004 Christoph
2004/0230637 A1 11/2004 Lecoueche et al.
2005/0010414 A1 * 1/2005 Yamazaki ..... G10L 13/04 704/266
2005/0075864 A1 * 4/2005 Kim ..... G10L 25/48 704/206
2005/0240401 A1 * 10/2005 Ebenezer ..... G10L 21/0208 704/226
2005/0246168 A1 * 11/2005 Campbell ..... G10L 25/00 704/214
2005/0265560 A1 12/2005 Haulick et al.
2006/0222184 A1 10/2006 Buck et al.
2007/0055513 A1 * 3/2007 Hwang ..... G10L 25/48 704/233
2007/0230712 A1 10/2007 Belt et al.
2007/0233472 A1 * 10/2007 Sinder ..... G10L 21/00 704/219
2008/0004881 A1 1/2008 Attwater et al.
2008/0082322 A1 * 4/2008 Joublin ..... G10L 25/48 704/209
2008/0107280 A1 5/2008 Haulick et al.
2008/0319740 A1 * 12/2008 Su ..... G10L 19/09 704/225
2009/0276213 A1 * 11/2009 Hetherington ..... G10L 25/78 704/233
2009/0316923 A1 12/2009 Tashev et al.
2010/0189275 A1 7/2010 Christoph
2010/0299148 A1 * 11/2010 Krause ..... G10L 25/69 704/237
2011/0119061 A1 * 5/2011 Brown ..... G10L 19/008 704/258

(56) References Cited

U.S. PATENT DOCUMENTS

| | | | | |
|---|---|---|---|---|
| 2011/0286604 | A1* | 11/2011 | Matsuo | G10K 11/1784 381/71.1 |
| 2012/0130711 | A1* | 5/2012 | Yamabe | G10L 25/78 704/231 |
| 2012/0134522 | A1* | 5/2012 | Jenison | H04R 25/505 381/320 |
| 2012/0150544 | A1* | 6/2012 | McLoughlin | G10L 25/03 704/262 |

FOREIGN PATENT DOCUMENTS

| | | | |
|---|---|---|---|
| CN | 104704560 | A | 6/2015 |
| DE | 101 56 954 | A1 | 6/2003 |
| DE | 10 2005 002 865 | B3 | 6/2006 |
| EP | 0 856 834 | A2 | 8/1998 |
| EP | 1 083 543 | A2 | 3/2001 |
| EP | 1 116 961 | A2 | 7/2001 |
| EP | 1 343 351 | A1 | 9/2003 |
| EP | 1 850 328 | A1 | 10/2007 |
| EP | 1 850 640 | A1 | 10/2007 |
| EP | 2 107 553 | A1 | 10/2009 |
| EP | 2 148 325 | A1 | 1/2010 |
| GB | 2 097 121 | A | 10/1982 |
| WO | WO 94/18666 | | 8/1994 |
| WO | WO 02/32356 | A1 | 4/2002 |
| WO | WO 2004/100602 | A2 | 11/2004 |
| WO | WO 2006/117032 | A | 11/2006 |
| WO | WO 2011/119168 | A1 | 9/2011 |

OTHER PUBLICATIONS

Notification Concerning Transmittal of International Preliminary Report on Patentability (Chapter 1 of the Patent Cooperation Treaty, PCT/US2012/053666, date of mailing Mar. 19, 2015, 6 pages.
Notification of Transmittal of the International Search Report and the Written Opinion of the International Searching Authority, or the Declaration, PCT/US2012/053666, date of mailing Dec. 11, 2012, 5 pages.
Written Opinion of the International Searching Authority, PCT/US2012/053666, date of mailing Dec. 11, 2012, 6 pages.
Kobatake H. et al.,: "Enhancement of noisy speech by maximum likelihood estimation", Speech Processing 1. Toronto, May 14-17, 1991; [International Conference on Acoustics, Speech & Signal Processing. ICASSP], New York, IEEE, US, vol. CONF. 16, Apr. 14, 1991, pp. 973-976, XP010043136, DOI: 10.1109/ICASSP.1991.150503; ISBN: 978-0-7803-0003-3. Abstract p. 975, paragraph [4. Practical computation] p. 975, paragraph [6. Conclusion] figure 4.
Lecomte I. et al.,: "Car noise processing for speech input", May 23, 1989; May 23, 1989-May 26, 1989, May 23, 1989, pp. 512-515, XP010083112. Abstract pp. 513-514, paragraph [Speech enhancement] figure 2; tables 1-3.
Chinese Office Action (with English translation) dated Aug. 10, 2016; for Chinese Pat. App. No. 201280074944.2; 22 pages.
Richardson et al. "LPC-Synthesis Mixture: A Low Computational Cost Speech Enhancement Algorithm", Proceedings of the IEEE, Apr. 11, 1996, 4 pages.
Arslan et al. "New Methods for Adaptive Noise Suppression," IEEE, vol. 1, May 1995, 4 pages.
Ljolje et al. "Discriminative Training of Multi-Stage Barge-in Models," IEEE, Dec. 1, 2007, 6 pages.
Setlur et al. "Recognition-based Word Counting for Reliable Barge-In and Early Endpoint Detection in Continuous Speech Recognition," International Conference on spoken Language Processing, Oct. 1, 1998, 4 pages.
Ittycheriah et al. "Detecting User Speech in Barge-in Over Prompts Using Speaker Identification Methods," Eurospeech 99, Sep. 5, 1999, 4 pages.
Rose et al. "A Hybrid Barge-In Procedure for More Reliable Turn-Taking in Human-Machine Dialog Systems," 5th International Conference on Spoken Language Processing, Oct. 1, 1998, 6 pages.
Hansler et al. "Acoustic Echo and Noise Control: A Practical Approach", John Wiley & Sons, New York, New York, USA, Copyright 2004, Part 1, 250 pages.
Hansler et al. "Acoustic Echo and Noise Control: a Practical Approach", John Wiley & Sons, New York, New York, USA, Copyright 2004, Part 2, 221 pages.
Sang-Mun Chi et al: "Lombard effect compensation and noise suppression for noisy Lombard speech recognition", IEEE, US, vol. 4, Oct. 3, 1996 pp. 2013-2016, 4 pages.
Schmidt et al: "Signal processing for in-car communication systems", Signal Processing, Elsevier Science Publishers B.V. Amsterdam, NL, vol. 86, No. 6, Jun. 1, 2006, pp. 1307-1326, 20 pages.
Jung et al: "On the Lombard Effect Induced by Vehicle Interior Driving Noises, Regarding Sound Pressure Level and Long-Term Average Speech Spectrum", Mar. 1, 2012, pp. 334-341, ISSN: 1610-1928, 8 pages.
Alfonso Ortega et al: "Cabin car communication system to improve communications inside a car", IEEE May 13, 2002, pp. IV-3836, 4 pages.
Extended Search Report dated Sep. 19, 2008 for European Application No. 08013196.4; 11 pages.
Decision to grant dated Feb. 28, 2014 for European Application No. 08013196.4; 52 pages.
Supplemental Decision to grant dated May 27, 2014 for European Application No. 08013196.4; 43 pages.
Office Action dated Apr. 1, 2013 for U.S. Appl. No. 12/507,444, 17 pages.
Response to Office Action dated Aug. 1, 2013 U.S. Appl. No. 12/507,444, 16 pages.
Final Office Action dated Nov. 15, 2013 for U.S. Appl. No. 12/507,444, 19 pages.
Office Action dated Jun. 14, 2013 for U.S. Appl. No. 12/254,488; 22 pages.
Response to Office Action dated Dec. 4, 2013 for U.S. Appl. No. 12/254,488; 12 pages.
Notice of Allowance dated Dec. 23, 2013 for U.S. Appl. No. 12/254,488; 11 pages.
European Search Report Apr. 24, 2008 for European Application No. 07021121.4, 3 pages.
European Extended Search Report dated May 6, 2008 for European Application No. 07021121.4, 3 pages.
European Search Report dated Jun. 14, 2011 for European Application No. 07021932.4, 2 pages.
Decision to Grant dated Dec. 5, 2013 for European Application No. 07021932.4, 1 page.
International Preliminary Report on Patentability dated Nov. 11, 2005 for PCT Application No. PCT/EP2004/004980; 8 pages.
Written Opinion dated Nov. 8, 2004 for PCT Application No. PCT/EP2004/004980; 7 pages.
Search Report dated Nov. 8, 2004, 2004 for PCT Application No. PCT/EP2004/004980; 3 pages.
Office Action dated Nov. 28, 2007 for U.S. Appl. No. 10/556,232; 11 pages.
Response to Office Action files Mar. 28, 2008 for U.S. Appl. No. 10/556,232; 7 pages.
Office Action dated May 29, 2008 for U.S. Appl. No. 10/556,232; 10 pages.
Response to Office Action files Aug. 29, 2008 for U.S. Appl. No. 10/556,232; 9 pages.
Office Action dated Dec. 9, 2008 for U.S. Appl. No. 10/556,232; 17 pages.
Response to Office Action files Mar. 9, 2009 for U.S. Appl. No. 10/556,232; 13 pages.
Office Action dated May 13, 2009 for U.S. Appl. No. 10/556,232; 17 pages.
Response to Office Action files May 29, 2009 for U.S. Appl. No. 10/556,232; 6 pages.
Notice of Allowance dated Aug. 26, 2009 for U.S. Appl. No. 10/556,232; 7 pages.
Notice of Allowance dated Jan. 15, 2014 for U.S. Appl. No. 11/924,987; 7 pages.
Office Action dated Jan. 7, 2014 for U.S. Appl. No. 13/518,406; 10 pages.

(56) References Cited

OTHER PUBLICATIONS

Response to Office Action filed May 5, 2014 for U.S. Appl. No. 13/518,406; 8 pages.
Final Office Action dated Jun. 10, 2014 for U.S. Appl. No. 13/518,406; 10 pages.
Response to Final Office Action filed Nov. 13, 2014 for U.S. Appl. No. 13/518,406; 11 pages.
Office Action dated Nov. 26, 2014 for U.S. Appl. No. 13/518,406; 6 pages.
Response to Office Action filed Feb. 17, 2015 for U.S. Appl. No. 13/518,406; 9 pages.
Notice of Allowance dated Mar. 10, 2015 for U.S. Appl. No. 13/518,406; 7 pages.
European Office Action dated Oct. 16, 2014 for European Application No. 10716929.4; 5 pages.
Decision to grant dated Jan. 18, 2016 for European Application No. 10716929.4; 24 pages.
Response to Written Opinion filed Jan. 9, 2015 for European Application No. 10716929.4; 9 pages.
International Preliminary Report on Patentability dated Oct. 2, 2012 for PCT Application No. PCT/US2010/028825; 8 pages.
Search Report dated Dec. 28, 2010 for PCT Application No. PCT/US2010/028825; 4 pages.
Written Opinion 2010 dated Dec. 28, 2010 for PCT Application No. PCT/US2010/028825; 7 pages.
Extended Search Report dated Jul. 20, 2016 for European Application No. 12878823.9; 16 pages.
Supplementary Search Report dated Aug. 5, 2016 for European Application No. 12878823.9; 1 pages.
Notice of Allowance dated Aug. 15, 2016 for U.S. Appl. No. 14/406,628; 12 pages.
International Preliminary Report on Patentability dated May 14, 2015 for PCT Application No. PCT/US2012/062549; 6 pages.
Office Action dated Feb. 16, 2016 for U.S. Appl. No. 14/438,757; 12 pages.
Response to Office Action dated May 13, 2016 for U.S. Appl. No. 14/438,757; 15 pages.
Final Office Action dated Jul. 28, 2016 for U.S. Appl. No. 14/438,757; 12 pages.
EPO Extended Search Report dated Jun. 27, 2011 for European Application No. 11155021.6; 10 pages.
EPO Communication Pursuant to Article 94(3) EPC dated Jul. 5, 2013 for European Application No. 11155021.6; 2 pages.
Response to EPO Communication Pursuant to Article 94(3) EPC dated Oct. 8, 2013 for European Application No. 11155021.6; 11 pages.
U.S. Appl. No. 11/928,251.
U.S. Appl. No. 12/507,444.
U.S. Appl. No. 12/254,488.
U.S. Appl. No. 12/269,605.
U.S. Appl. No. 13/273,890.
U.S. Appl. No. 14/254,007.
U.S. Appl. No. 10/556,232.
U.S. Appl. No. 13/518,406.
U.S. Appl. No. 14/406,628.
European Response (with Amended Claims and Replacement Specification Page) to European Office Action dated Aug. 5, 2016; Response filed on Jan. 25, 2017 for European Application No. 12878823.9; 10 Pages.
Chinese Office Action with English translation dated Nov. 16, 2016; for Chinese Pat. App. No. 201280076334.6; 13 pages.
Chinese Response with English claims filed Dec. 26, 2016 to Office Action dated Aug. 10, 2016; for Chinese Pat. App. No. 201280074944.2; 20 pages.
Response to Office Action filed on Oct. 25, 2016 for U.S. Appl. No. 14/438,757, 17 pages.
Notice of Allowance dated Nov. 9, 2016 for U.S. Appl. No. 14/438,757, 10 pages.
U.S. Appl. No. 14/406,628 Notice of Allowance dated Aug. 15, 2016, 12 pages.
Response (with Amended Claims in English) to Chinese Office Action dated Nov. 16, 2016 for Chinese Application No. 201280076334.6; 11 Pages.
Response (with Amended Claims in English) to Chinese Office Action dated Jan. 17, 2017 for Chinese Application No. 201280074944.2; 18 Pages.
Chinese Office Action (with English Translation) dated Jan. 17, 2017 for Chinese Application No. 201280074944.2; 16 Pages.
Chinese Office Action (with English translation) dated Jun. 2, 2017, for Chinese Pat. App. No. 201280074944.2, 10 pages.
Chinese Second Office Action (with English translation) dated Jun. 26, 2017, for Chinese Pat. App. No. 201280076334.6; 14 pages.
Response to Chinese Office Action dated Jun. 2, 2017 for Chinese Application No. 201280074944.2; Response filed on Aug. 17, 2017; 13 pages.

* cited by examiner

FORMANT DEPENDENT SPEECH SIGNAL ENHANCEMENT

TECHNICAL FIELD

The present invention relates to noise reduction in speech signal processing.

BACKGROUND ART

Common noise reduction algorithms make assumptions to the type of noise present in a noisy signal. The Wiener filter for example introduces the mean of squared errors (MSE) cost function as an objective distance measure to optimally minimize the distance between the desired and the filtered signal. The MSE however does not account for human perception of signal quality. Also, filtering algorithms are usually applied to each of the frequency bins independently. Thus, all types of signals are treated equally. This allows for good noise reduction performance under many different circumstances.

However, mobile communication situations in an automobile environment are special in that they contain speech as their desired signal. The noise present while driving is mainly characterized by increasing noise levels with lower frequency. Speech signal processing starts with an input audio signal from a speech-sensing microphone. The microphone signal represents a composite of multiple different sound sources. Except for the speech component, all of the other sound source components in the microphone signal act as undesirable noise that complicates the processing of the speech component. Separating the desired speech component from the noise components has been especially difficult in moderate to high noise settings, especially within the cabin of an automobile traveling at highway speeds, when multiple persons are simultaneously speaking, or in the presence of audio content.

In speech signal processing, the microphone signal is usually first segmented into overlapping blocks of appropriate size and a window function is applied. Each windowed signal block is then transformed into the frequency domain using a fast Fourier transform (FFT) to produce noisy short-term spectra signals. In order to reduce the undesirable noise components while keeping the speech signal as natural as possible, SNR-dependent (SNR: signal-to-noise ratio) weighting coefficients are computed and applied to the spectra signals. However, existing conventional methods use an SNR-dependent weighting rule which operates in each frequency independently and which does not take into account the characteristics of the actual speech sound being processed.

FIG. 1 shows a typical arrangement for noise reduction of speech signals. An analysis filter bank 102 receives in the microphone signal y(i) from microphone 101. y(i) includes both the speech components (i) and a noise component n(i) that is received by the microphone. The parameter (i) is the sample index, which identifies the time-period for the sample of the microphone signal y. The analysis filter bank 102 converts the time-domain-microphone sample into a frequency-domain representation frame by applying an FFT. The analysis filter bank 102 separates the filter coefficients into frequency bins. As noted in the figure, the frequency domain representation of the microphone signal is $Y(k,\mu)$ wherein k represents the frame index and $\mu$ represents the frequency bin index. The frequency domain representation of the microphone signal is provided to a noise reduction filter 103. Signal to noise ratio weighting coefficients are calculated in the noise reduction filter resulting in the filter coefficients $H(k\ \mu)$ and the filter coefficients and the frequency domain representation are multiplied resulting in a reduced noise signal $\hat{S}(k,\mu)$. noise reduced frequency domain signals are collected in the synthesis filter bank for all frequencies of a frame and the frame is passed through an inverse transform (e.g. an inverse FFT).

SUMMARY

Embodiments of the present invention are directed to an arrangement for speech signal processing. The processing may be accomplished on a speech signal prior to speech recognition. The system and methodology may also be employed with mobile telephony signals and more specifically in an automotive environments that are noisy, so as to increase intelligibility of received speech signals.

An input microphone signal is received that includes a speech signal component and a noise component. The microphone signal is transformed into a frequency domain set of short-term spectra signals. Then speech formant components within the spectra signals are estimated based on detecting regions of high energy density in the spectra signals. One or more dynamically adjusted gain factors are applied to the spectra signals to enhance the speech formant components.

A computer-implemented method that includes at least one hardware implemented computer processor, such as a digital signal processor, may process a speech signal and identify and boost formants in the frequency domain. An input microphone signal having a speech signal component and a noise component may be received by a microphone.

The speech pre-processor transforms the microphone signal into a frequency domain set of short term spectra signals. Speech formant components are recognized within the spectra signals based on detecting regions of high energy density in the spectra signals. One or more dynamically adjusted gain factors are applied to the spectra signals to enhance the speech formant components.

The formants may be identified and estimated based on finding spectral peaks using a linear predictive coding filter. The formants may also be estimated using an infinite impulse response smoothing filter to smooth the spectral signals. After the formants are identified, the coefficients for the frequency bins where the formants are identified may be boosted using a window function. The window function boosts and shapes the overall filter coefficients. The overall filter can then be applied to the original speech input signal. The gain factors for boosting are dynamically adjusted as a function of formant detection reliability. The shaped windows are dynamically adjusted and applied only to frequency bins that have identified speech. In certain embodiments of the invention, the boosting window function may be adapted dynamically depending on signal to noise ratio.

In embodiments of the invention, the gain factors are applied to underestimate the noise component so as to reduce speech distortion in formant regions of the spectra signals. Additionally, the gain factors may be combined with one or more noise suppression coefficients to increase broadband signal to noise ratio.

The formant detection and formant boosting may be implemented within a system having one or more modules. As used herein, the term module may imply an application specific integrated circuit or a general purpose processor and associated source code stored in memory. Each module may include one or more processors. The system may include a speech signal input for receiving a microphone signal having a speech signal component and a noise component. Additionally, the system may include a signal pre-processor for transforming the microphone signal into a frequency domain set of short term spectra signals. The system includes both a formant estimating module and a formant enhancement module. The formant estimating module estimates speech formant components within the spectra signals based on detecting regions of high energy density in the spectra signals. The formant enhancement module determines one or more dynamically adjusted gain factors that are applied to the spectra signals to enhance the speech formant components.

DETAILED DESCRIPTION

Various embodiments of the present invention are directed to computationally efficient techniques for enhancing speech quality and intelligibility in speech signal processing by identifying and accentuating speech formants within the microphone signals. Formants represent the main concentration of acoustical energy within certain frequency intervals (the spectral peaks) which are important for interpreting the speech content. Formant identification and accentuation may be used in conjunction with noise reduction algorithms.

Figure 1:
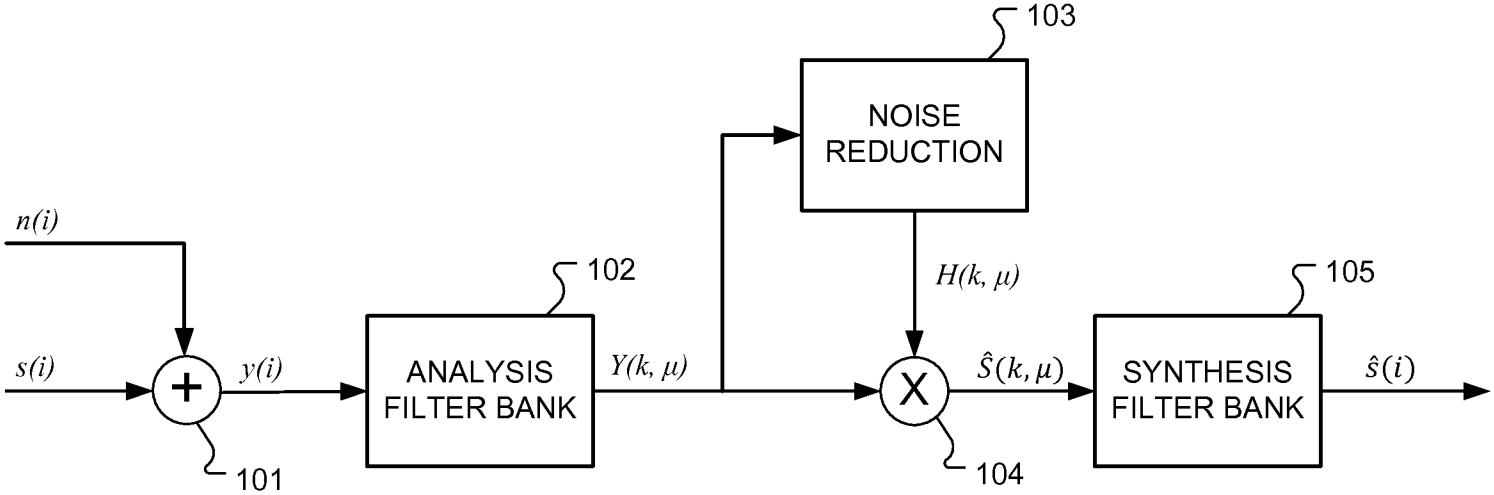
FIG. 1 shows a typical prior art arrangement for noise reduction of speech signals.
Figure 2:
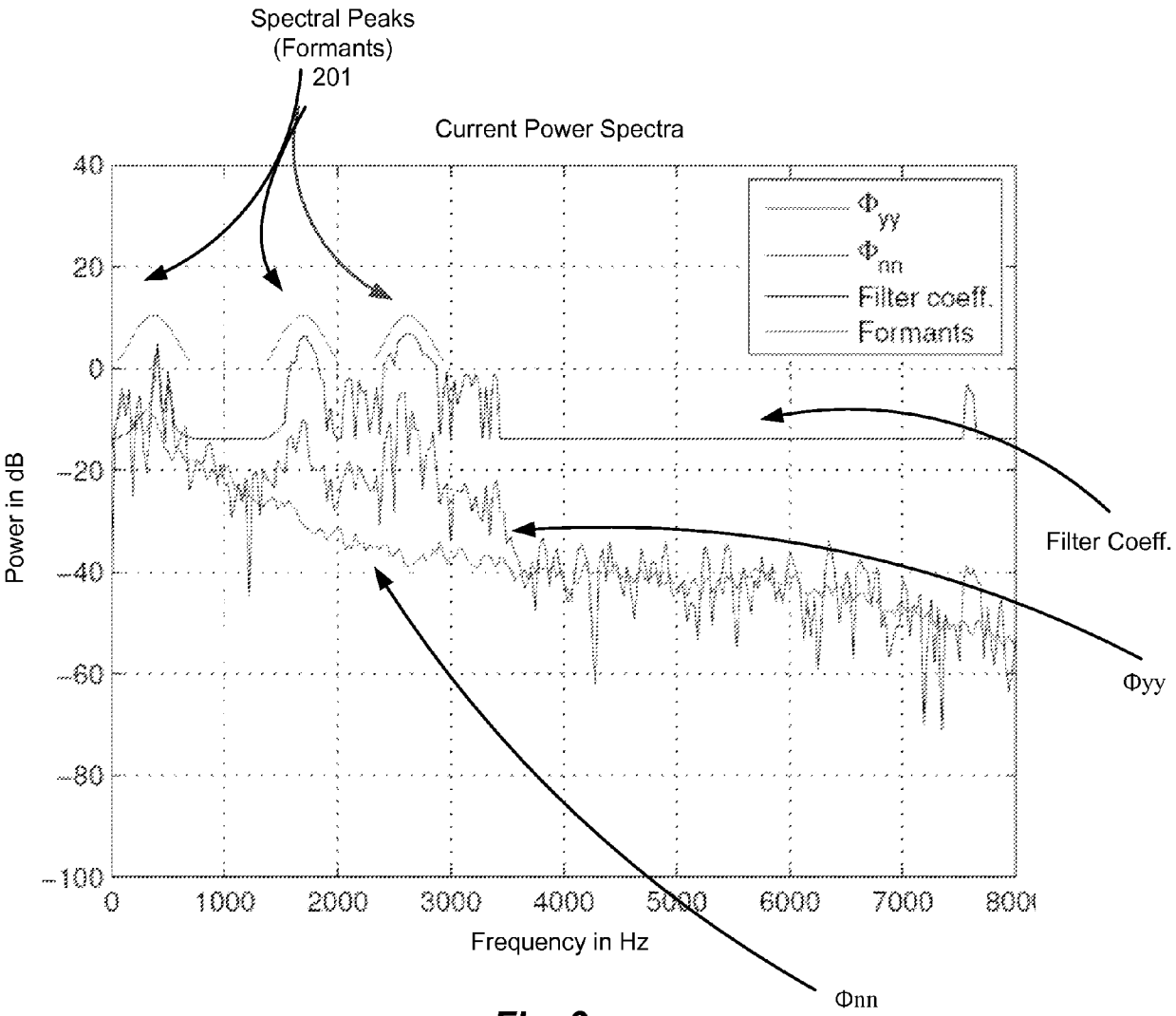
FIG. 2 shows a graph of a speech spectra signal showing how to identify the formant components therein.

FIG. 2 shows a graph of a speech spectra signal and the component parts that can be used for identifying the spectral peaks and therefore, the formants. The first component Syy represents the power spectral density of the voiced portion of the microphone signal. The second component, $\overline{S}$yy, represents the estimated power spectral density of the noise component of the microphone signal; and the third component, Filter Coeff. represents the filter coefficients after noise suppression and formant augmentation. The formants for this speech signal are identified by the spectral peaks 201.

Figure 3:
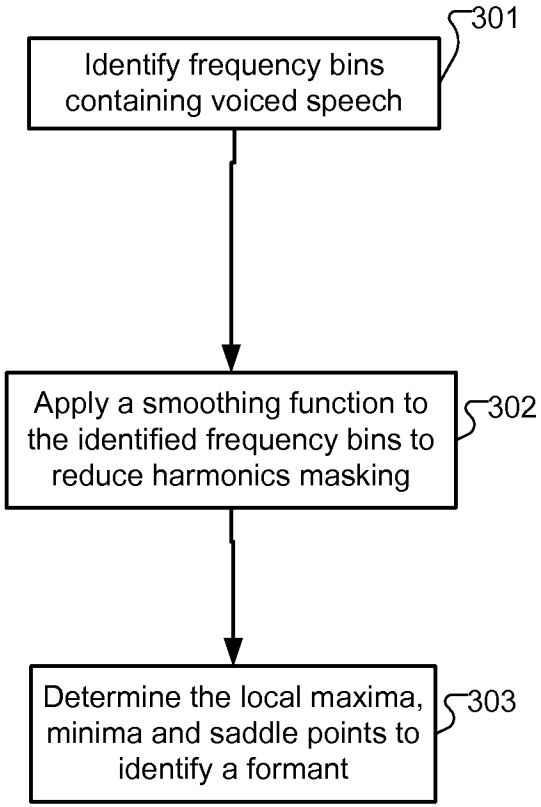
FIG. 3 shows a flow chart for determining the location of formants.

FIG. 3 provides a flowchart for formant identification. Formants are the frequency portions of a signal in which the excitation signal was amplified by a resonance filter. This excitation results in a higher power spectral density (PSD) compared to the excitation's PSD around any formant's central frequency and also compared to neighboring frequency bands, unless another formant is present there. Assuming that besides the vocal tract formants, no other significant formants are present (e.g. strong environment resonances), formants can be found by finding locally high PSD bands. Not all locally high PSD bands are indicative of formants. An unvoiced excitation, such as a fricative, should not be identified as a formant. In order to avoid boosting fricatives, a frequency band restriction for the detection of formants may be used. For example, $f_F$,max=3500 Hz. Additionally, neither should any boosting take place in frames without voice activity. Thus, formant identification should also include a voiced excitation detector, for limiting the number of searched frames. By reducing the number of relevant frames and also frequency bins, these restrictions reduce the computational complexity of the detection process.

As stated above, formants should be accentuated only during voiced speech phonemes and on those formant regions where the SNR (signal-to-noise ratio) is sufficient. Otherwise, noise components will be amplified, which leads to a reduced speech quality. In a first step, the inventive method first identifies frequency regions of the input speech signal containing voiced speech. 301 In order to accomplish this, a voiced excitation detector is employed. Any known excitation detector may be used and the below described detector is only exemplary. In one embodiment, the voiced excitation detector module decides whether the mean logarithmic INR (Input-to-Noise ratio) exceeds a certain threshold $P_{VUD^*}$ over a number ($M_F$) of frequency bins:

$$P_{VUD}(n) = \frac{1}{M_F}\sum_{\mu=1}^{M_F} INR(\mu, n)$$

$$VUD(n) = \begin{cases} \text{true} & \text{for } P_{VUD}(n) > P^*_{VUD} \\ \text{false} & \text{otherwise.} \end{cases}$$

If the result is true, a voice signal is recognized. If the result is false, the frequency bins in the current frame, denoted here with n, do not contain speech.

Once the frames having speech are identified, an optional smoothing function may be applied to the speech signal to eliminate the problem of harmonics masking the superposed formants. 302. A first-order infinite impulse response (IIR) filter may be applied for smoothing, although other spectral smoothing techniques may be applied without deviating from the intent of the invention (e.g. spline, fast and slow smoothing etc.). The smoothing filter should be designed to provide an adequate attenuation of the harmonics' effects while not cancelling out any formants' maxima.

An exemplary filter is defined below and this filter is applied once in forward direction and once in backward direction so as to keep local features in place. It has the form:

$$S'_{yy}(f_\mu, n) = \begin{cases} S_{yy}(f_1, n) & \text{for } \mu = 1, \\ \gamma_f \cdot S'_{yy}(f_{\mu-1}, n) + (1-\gamma_f)\cdot S_{yy}(f_\mu, n) & \text{for } \mu \in [2 \ldots M], \end{cases}$$

and $$\overline{S}_{yy}(f_\mu, n) = \begin{cases} S'_{yy}(f_M, n) & \text{for } \mu = M, \\ \gamma_f \cdot \overline{S}_{yy}(f_{\mu-1}, n) + (1-\gamma_f)\cdot S'_{yy}(f_\mu, n) & \text{for } \mu \in [1 \ldots M-1]. \end{cases}$$

With the given transformation parameters (sampling frequency FS=16000 Hz and window width NFFT=512, a good compromise numerical smoothing constant was found to be gamma_f=0.92. This corresponds to a natural decay constant of:

$$\beta_f = \frac{N_{FFT}}{F_S}\ln\gamma_f \approx -2.668\cdot 10^{-3} s$$

-continued $$\gamma'_f = \frac{N_{FFT}}{f_S}\ln\gamma_f \approx -2.668\cdot 10^{-3}s$$

for arbitrary short-term Fourier transform (STFT) parameters. The STFT-dependent parameter is then:

$$\gamma'_f(N_{FFT}, F_S) = e^{\frac{F_S}{N_{FFT}}\beta_f}$$

$$\gamma_f(N_{FFT}, f_S) = e^{\frac{F_S}{N_{FFT}}\gamma'_f}.$$

After smoothing the PSD, the local maxima are determined by finding the zeros of the derivative of the smoothed PSD within the respective frequency bins 303. Streaks of zeros are consolidated, and an analysis of the second derivative is used to classify minima, maxima, and saddle points as is known to those of ordinary skill in the art. The maximum point will be assumed to be the central frequency of the formant $f_F(i_F,n)$ and—in the case of fast and slow smoothing—the width of the formant will be known $\Delta f_F(i_F,n)$.

Once the formants are identified, the formant regions can be accentuated using an adaptive gain factor. A boosting function B (f, n) with codomain [0, 1], where a value of 0 should represent the absence of any formants in the respective frequency bin, while a value of 1 should demark a formant's center.

We introduce the prototype boosting window function $b_{prot}(x):\mathbb{R}\rightarrow[0,1]$ with $$b_{prot}(x) = \begin{cases} \hat{b}_{prot}(x), & \forall x \in \left[-\frac{1}{2}+\frac{1}{2}\right] \\ 0 & \text{otherwise,} \end{cases}$$

where $\tilde{b}_{prot}(x)$:

$$\left[-\frac{1}{2}+\frac{1}{2}\right] \rightarrow [0, 1]$$

defines the actual prototype window shape.

Figure 3A:
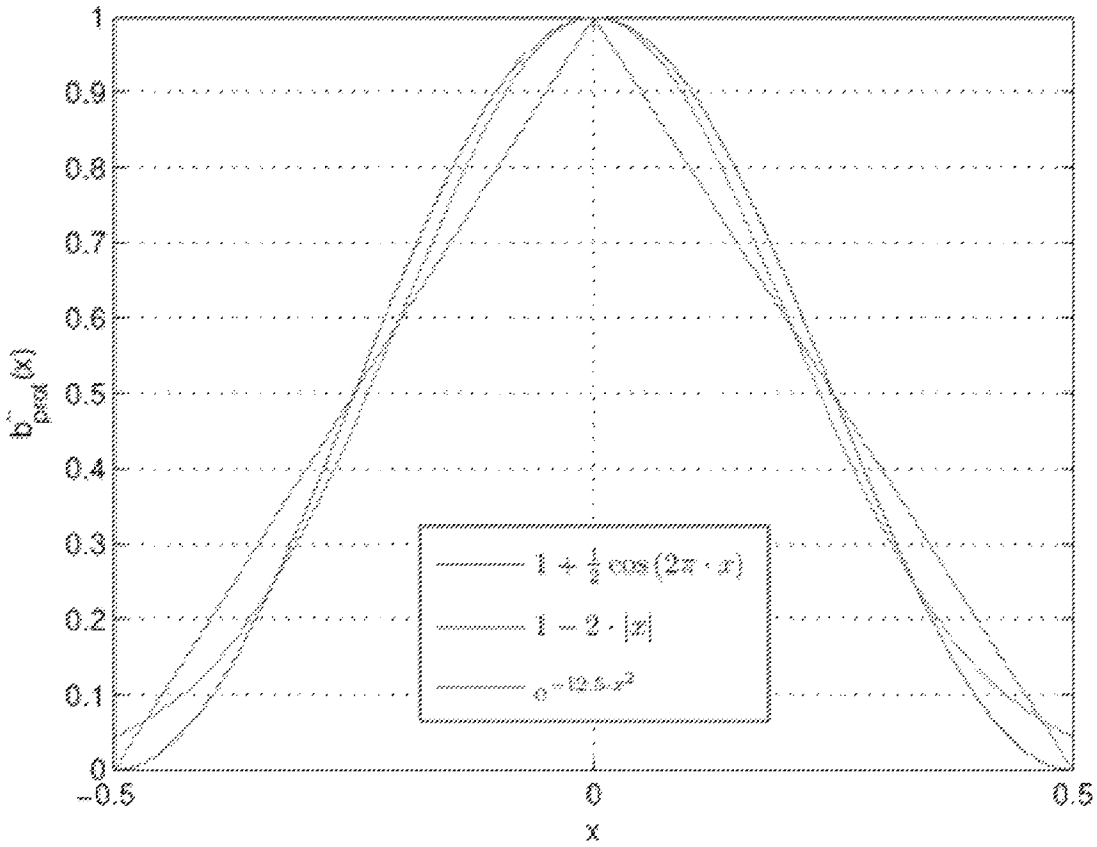
FIG. 3A shows possible boosting window functions.

Within any formant, the highest signal-to-noise ratio (SNR) can be expected at its center. The introduction of noise by boosting the signal increases towards formants' borders. Thus, typical boosting around a formant's center preferably should fall off gently. FIG. 3A shows a plurality of possible window functions that meet this criteria. For example, a Gaussian function may be used as a prototype boosting window function to assure gentle fall-off. The window of the present example is centered around x=0 and has unity width. Centering around x=0 as well as unity widths allows for a common operational space, so that subsequent processing, such as stretching and shifting of the window can be readily handled.

Different shaped windows, such as, Gaussian, cosine, and triangular windows can be used. Different weighting rules can be utilized to boost the input signal. Preferably the boosting window emphasizes the center frequencies of formants and the window is stretched over a frequency range. For each formant detected, the prototype window function is stretched by a factor w (iF, n) to match the formant's width, if it is known—as is the case for the approach with fast and slow smoothing. Otherwise, it should be stretched to a constant frequency width of about 600 Hz although other similar frequency ranges may be employed.

The window must also be shifted by the formant's central frequency to match its location in the frequency domain. The boosting function is defined to be the sum of the stretched and shifted prototype boosting window functions:

$$B(f, n) := \sum_{i_F=1}^{N_F(n)} b_{prot}\left(\frac{f - f_F(i_F, n)}{w(i_F, n)}\right)$$

In other embodiments of the invention, the gain values around the center of the shaped windows may be adjusted depending on the presumed reliability of the formant estimation. Thus, if the formant estimation reliability is low, the windowing function will not boost the frequency components as much when compared to a highly reliable formant estimation.

In order to avoid detection of formants within the speech signal (e.g. frame) when no actual speech is present, prior estimated formants can also be taken into account for adjustments to the window function. In general, the formant locations slowly change over time depending on the spoken phoneme.

Figure 4:
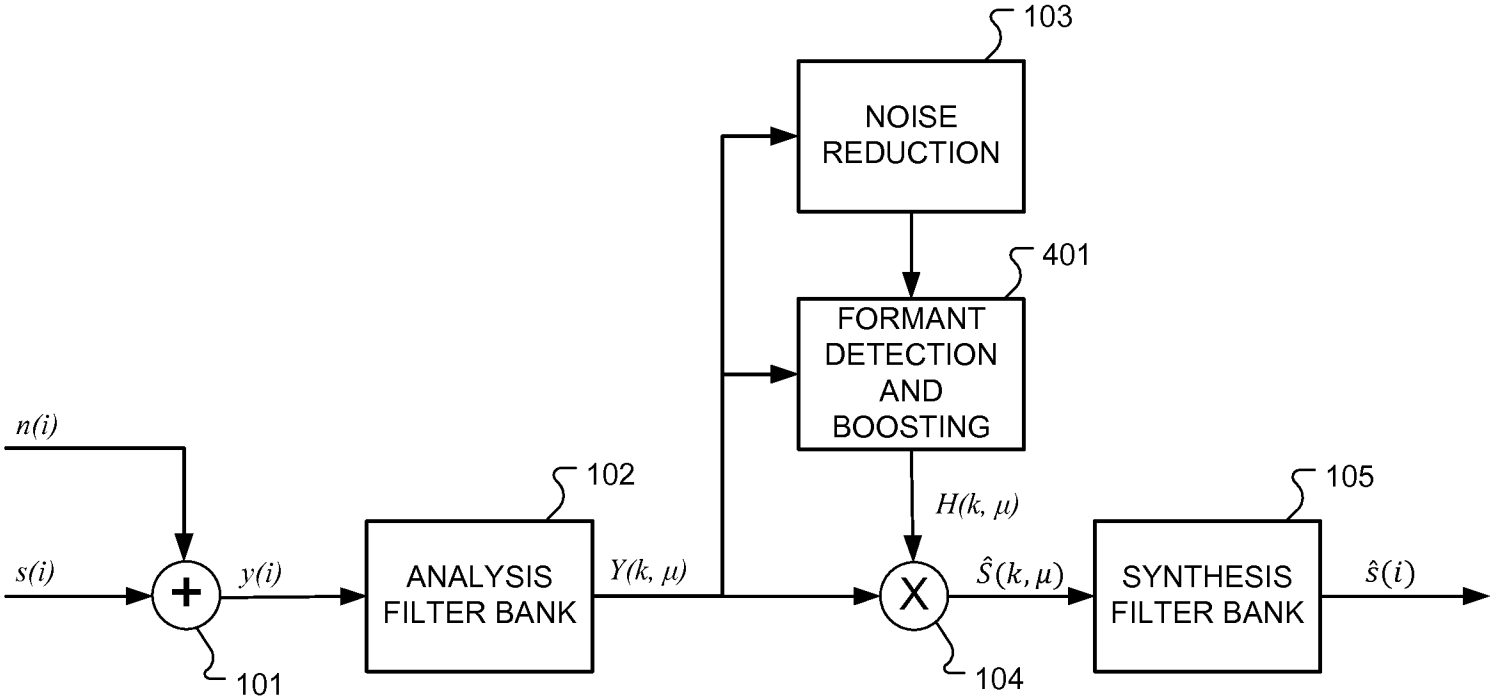
FIG. 4 shows an embodiment of the present invention for noise reduction of speech signals including formant detection and formant boosting.

FIG. 4 shows an embodiment of the formant boosting and detecting methodology implemented into a system where a speech signal is received by a microphone and is processed to reduce noise prior to being provided to a speech recognition engine or output through an audio speaker to a listener. As shown in FIG. 4 microphone signal y(i) is passed through an analysis filter bank 102. The sampled microphone signals are converted in the analysis filter bank 102 into the frequency domain by employing a FFT resulting in a sub-band frequency-based representation of the microphone signal $Y(k,\mu)$. As expressed above, this signal is composed of a plurality of frames k for a plurality of frequency bins (e.g. segments, ranges, sub-bands). The frequency-based representation is provided to a noise reduction module 103 as well as to the formant detection module. For example, the noise reduction module may contain a modified recursive Wiener Filter as described in "Spectral noise subtraction with recursive gain curves," by Klaus Linhard and Tim Haulick, ICSLP 1998 (International Conference on Spoken Language Processing). The recursive Wiener filter of the Linhard and Haulick reference may be defined by the following equation:

$$H(f_\mu, n) = \max\left(1 - \frac{\alpha}{H(f_\mu, n-1)}\cdot\frac{S_{bb}(f_\mu, n)}{S_{yy}(f_\mu, n)}, \beta\right)$$

where α is the overestimation factor, and β is the spectral floor. Here, the spectral floor acts as both a feedback limit, and the classical spectral floor that masks musical noise.

$$\frac{S_{yy}(f_\mu, n)}{S_{bb}(f_\mu, n)}$$

can be replaced by $INR(f_\mu,n)$ to get $$H(f_\mu, n) = \max\left(1 - \frac{\alpha}{H(f_\mu, n-1)\cdot INR(f_\mu, n)}, \beta\right)$$

To find the equilibrium map in its input-state space, set $$H'(f_\mu,n) \stackrel{!}{=} H''(f_\mu,n-1) =: H'_{eq}$$

and $$INR(f_\mu,n) =: INR'_{eq}.$$

This leads to $$H'_{eq} = 1 - \frac{\alpha}{INR'_{eq} \cdot H'_{eq}}.$$

This is an implicit representation of the reduced system's equilibrium map. It can be transformed to give the $INR'_{eq}$ as a function of the system's output $H'_{eq}$:

$$INR'_{eq}(\alpha, H'_{eq}) = \frac{\alpha}{H'_{eq} \cdot (1 - H'_{eq})},$$

or to give a quasi-function. of $H'_{eq}$ with two branches in the $INR'_{eq}$ domain:

$$H'_{eq}(\alpha, INR'_{eq}) = \frac{1}{2} \pm \sqrt{\frac{1}{4} - \frac{\alpha}{INR'_{eq}}}.$$

This system has two distinct equilibria. A top branch is stable on both sides while the lower branch is unstable. Left of the bifurcation point, the filter's output constantly decreases toward zero, so the filter is closed almost completely as soon as a low input INR is reached. The noise reduction filter's output H (fμ, n)—represents filter coefficients of values between 0 and 1 for each frequency bin μ in a frame n. It should be understood by one of ordinary skill in the art that other noise reductions filters may be employed in combination with formant detection and boosting without deviating from the intent of the invention and therefore, the present invention is not limited solely to recursive Wiener filters. Filters with a similar feedback structure as the modified Wiener filter (e.g. modified power subtraction, modified magnitude subtraction) can be further enhanced by placing their hysteresis flanks depending on the formant boosting function. Arbitrary noise reduction filters (e.g., Y. Ephraim, D. Malah: *Speech Enhancement Using a Minimum Mean-Square Error Short-Time Spectral Amplitude Estimator*, IEEE Trans. Acoust. Speech Signal Process., vol. 32, no. 6, pp 1109-1121, 1984.) can be enhanced by applying additional gain on their output filter coefficients depending on the formant boosting function.

Once the filter coefficients of the noise reduction filter are determined, the coefficients are provided to the formant booster 401. The formant booster 401 first detects formants in the spectrum of the noise reduced signal. The formant booster may identify all high power density bands as formants or may employ other detection algorithms. The detection of formants can be performed using linear predictive coding (LPC) techniques for estimating the vocal tract information of a speech sound then searching for the LPC spectral peaks. In one embodiment, a voice excitation detection methodology is employed as described with respect to FIG. 3. Formant detection may be further enhanced by requiring a minimum clearance between formants. For example, identified peaks within a predefined frequency range (ex. 300, 400, 500 or 600 Hz) may be considered to be the same formant and outside of the frequency range to be different formants. A reasonable distance between two neighboring formants is a fraction of 80 percent of their average widths. Additionally, a further requirement may be set on the mean TNR (input-to-noise ratio) present within each formant in order to avoid boosting formants in areas with too much noise. Once the frequency bins that include formants are identified, the frequency boosting module 401 will boost the formant frequencies, particularly the central frequency of the formant (e.g. the relative maximum frequency for the frequency bin). In order to perform the formant-dependent amplification mentioned, a multiple Bmax of the boosting function B (fμ, n) is added to the filter coefficients. Bmax is the desired maximum amplification in the center of the formants.

After the formants have been boosted within their respective frequency bins, the resultant filter coefficients H(k,μ) are convolved with the digital microphone signal resulting in a reduced noise and formant boosted signal $\hat{S}(k, \mu)$. The signal, which is still in the frequency domain and composed of frequency bins and temporal frames, is passed through a synthesis filter bank to transform the signal into the time domain. The resulting signal represents an augmented version of the original speech signal and should be better defined, so that a subsequent speech recognition engine (not shown) can recognize the speech.

FIG. 4 shows an embodiment of the invention in which formant boosting is performed subsequent to noise reduction through a noise reduction filter. By performing this post noise reduction filtering approach certain benefits are realized. Any frequency bins that have a good signal to noise ratio have the formants accentuated. By accentuating the signal portions as opposed to accentuating noise, intelligibility is improved. Post filtering boosting of the formants boosts the speech signal components that would be masked in surrounding noise. Because the signal is boosted and adds power, the formant boosted signal is louder compared to the corresponding conventionally noise reduced signal. In certain circumstances, this can lead to clipping if the system's dynamic range is exceeded. What is more, the speech signal's overall power in the formant band grows in relation to its power in the fricative band. The power contrast between formants' centers and frequency bands without formants is determined by the maximum amplification Bmax. The power contrast is responsible for the intelligibility increase and should not be reduced. Instead, after selective amplification, the frequency band that potentially contained formants (up to fF,max=3500 Hz) can be attenuated as a whole. The expected difference in power between the boosted and the unboosted signal can be made relatively low and preferably equal to zero.

In contrast to the process described above where the formants are boosted subsequent to a noise reduction filter, the disclosed formant detection method and boosting can also be applied as a preprocessing stage or as part of a conventional noise suppression filter. This methodology underestimates the background noise in formant regions and can be used to arbitrarily control the filter's parameters depending on the formants. In this approach, the noise suppression filter—is provoked to provide admission of formants that would normally be attenuated if all frequency bins were treated equally. As a consequence, the noise suppression filter operates less-aggressively, thus it reduces speech distortions to a certain extent. As previously indicated, in some embodiments of the invention, a recursive Wiener filter may be used as the noise suppression filter.

While the recursive Wiener filter effectively reduces musical noise, it also attenuates speech at low TNRs. The placement of the hysteresis edges, or flanks, in the filter's characteristic—determines at which INR signals are attenuated down to the spectral floor. Proper placement of the flanks will lead to a good trade-off between musical noise suppression and speech signal fidelity. It is desirable to modify the flanks' positions according to circumstance. In areas with only noise—the term area is used here to describe time spans as well as frequency bands—the musical noise suppression should remain prevalent while in areas with speech signal components (e.g. in formants), preserving the speech signal gets more important. By detecting important speech components in the form of formants, one gets a good weighting function between the two. For the recursive Wiener filter, the edges, or flanks, at which INR the filter closes (INR eq,down) or opens (INR eq,up) are given by:

$$INR_{eq,down}(\alpha) = 4\alpha, \text{ and}$$

$$INR_{eq,up}(\alpha, \beta) = \frac{\alpha}{\beta \cdot (1-\beta)}.$$

This system can be rearranged to describe the parameters α and β as functions of the flanks' desired INR:

$$\alpha(INR_{eq,down}) = \frac{INR_{eq,down}}{4}$$

$$\beta(INR_{eq,up}, INR_{eq,down}) = \frac{1 - \sqrt{1 - \frac{INR_{eq,down}}{INR_{eq,up}}}}{2}$$

The flanks can be independently placed by choosing adequate overestimation a and spectral floor β. If one chose β arbitrarily small, for example, to move the upwards flank towards a higher TNR, this would also result in a very low maximum attenuation, which might be undesirable. This may be eliminated by introducing a separate parameter Hmin that does not contribute to the feedback, but limits the output attenuation anyway. The proposed system is described by $$H(f_\mu, n) = \max\left(1 - \frac{\alpha}{H(f_\mu, n-1) \cdot INR(f_\mu, n)}, \beta\right) \text{ and}$$

$$\tilde{H}(f_\mu, n) = \max(H(f_\mu, n), H_{min}).$$

This filter can be tailored to different conditions better than could the conventional recursive Wiener filter. The boosting function can be put to use in this setup by defining the default flank positions ($INR_{up}^0$, $INR_{down}^0$) their desired maximum deviations ($\Delta INR_{up}$, $\Delta INR_{down}$) in the center of formants. Then, the filter parameters are updated in every frame and for every bin according to the presence of formants:

$$\alpha(f_\mu, n) = \frac{INR_{down}^0 + B(f_\mu, n) \cdot \Delta INR_{down}}{4} \text{ and}$$

-continued $$\beta(f_\mu, n) = \frac{1 - \sqrt{1 - \frac{INR_{down}^0 + B(f_\mu, n) \cdot \Delta INR_{down}}{INR_{up}^0 + B(f_\mu, n) \cdot \Delta INR_{up}}}}{2}$$

Where $B(f_\mu,n)$ is the formant boost window function. The formants can be determined as described above and the boost window function may also be selected from any of a number of window functions including Gaussian, triangular, and cosine etc.

If the formant boosting is performed prior or simultaneous with the noise reduction, there is no accentuation of the formants beyond 0 dB. Additionally, there is no further improvement of formants in bins that have good signal to noise ratios. Further, providing the boosting pre-noise reduction filtering potentially introduces additional noise. If the boosting is performed before the pre-noise reduction filtering audible speech improvements may occur especially in the lower frequencies.

Figure 5:
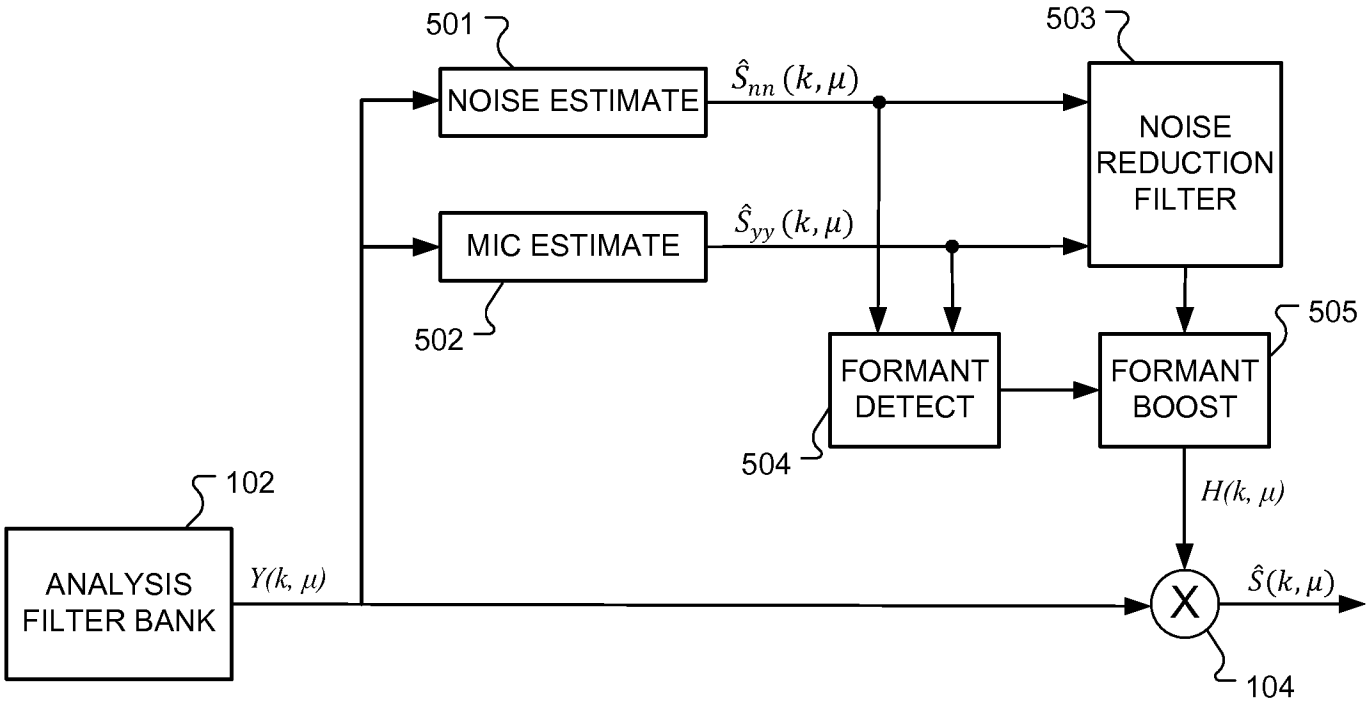
FIG. 5 shows further detail of one specific embodiment for noise reduction of speech signals.

FIG. 5 shows further detail of one specific embodiment for noise reduction of speech signals. The analysis filter bank 102 converts the microphone signal into the frequency domain. The frequency domain version of the microphone signal is passed to a noise estimate module 501 and also to a Microphone Estimate module 502 that estimates the short-time power density of the microphone signal. The short-time power density of the microphone signal and the noise signal estimate are provided to a formant detection module 505 The noise estimate is used by the formant boosting module to detect voiced speech activity and to compute the estimated INR needed to exclude bad INR formants from the boosting process. The formant detection module 404 may perform the signal analysis that is shown in FIG. 2 wherein the formants are identified according to spectral intensity peaks in the short-time power density of the microphone signal. The short-time power density and the noise estimate signal are also directed to a noise reduction filter 503. Any number of noise reduction algorithms may be employed for determining the noise-reduced coefficients. The noise-reduced coefficients are passed through the formant booster module 505 that boosts the coefficients related to the identified formants using a windowing function. The resulting gain coefficients of the formant boosting can then be combined with a regular noise suppression filter by using, e.g., the maximum of both filter coefficients. As a result, an improved broadband SNR can be achieved. The resulting signals are provided to a convolver 104 which combines the noise reduced filter coefficients and the frequency domain representation of the microphone signal that results in an enhanced version of the input speech signal. This signal is then presented to a synthesis filter bank (not shown) for returning the enhanced speech signal into the time domain. The enhanced time-domain signal is then provided to a speech recognizer (not shown).

Figure 6:
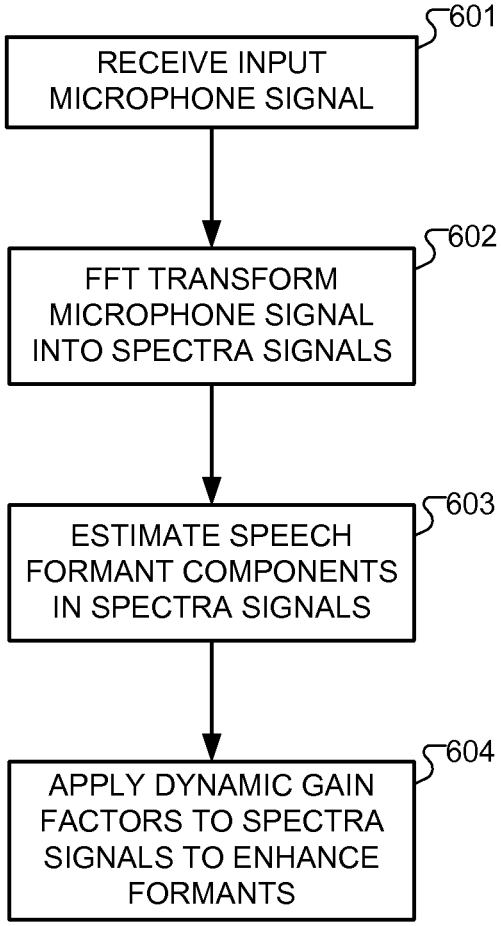
FIG. 6 shows various logical steps in a method of speech signal enhancement according to an embodiment of the present invention.

FIG. 6 shows various logical steps in a method of speech signal enhancement according to an embodiment of the present invention. First the microphone signal is received into a pre-speech recognition processor. 601. The pre-speech recognition processor performs an FFT transforming the time-domain microphone signal into the frequency domain. 602 The pre-speech recognition processor locates formants within the frequency bins of the frequency-domain microphone signal. 603 The processor may process the frequency domain-microphone signals by calculating the short-time energy for each frequency bin. The resulting dataset can be compared to a threshold value for determining if a formant is present. Using LPC the maxima are searched over the LPC-spectrum. In other embodiments of the invention, formant recognition can be performed using short-term power spectra with different smoothing constants. For example, the spectrum may have both a slow smoothing applied as well as a fast smoothing. Formants are detected on those frequency regions where the spectrum with a slow smoothing is larger than the spectrum with a high smoothing.

Once the formant frequency ranges are determined, the formants frequencies are boosted. 504 The frequencies may be boosted based on a number of factors. For example, only the center frequency may be boosted or the entire frequency range may be boosted. The level of boost may depend on the amount of boost provided to the last formant along with a maximum threshold in order to avoid clipping.

Embodiments of the invention may be implemented in whole or in part in any conventional computer programming language such as VHDL, SystemC, Verilog, ASM, etc. Alternative embodiments of the invention may be implemented as pre-programmed hardware elements, other related components, or as a combination of hardware and software components.

Embodiments can be implemented in whole or in part as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Although various exemplary embodiments of the invention have been disclosed, it should be apparent to those skilled in the art that various changes and modifications can be made which will achieve some of the advantages of the invention without departing from the true scope of the invention.

What is claimed is:

1. A computer-implemented method employing at least one hardware implemented computer processor for speech signal processing comprising:

receiving an input microphone signal having a speech signal component and a noise component;

transforming the microphone signal into a frequency domain set of short term spectra signals;

estimating speech formant components within the spectra signals based on detecting regions of high energy density in the spectra signals;

applying one or more dynamically adjusted gain factors to the spectra signals to enhance the speech formant components only during voiced speech phonemes and on the speech formant components having signal-to-noise ratio above a threshold;

adjusting the gain factors around a center frequency of the speech formant components based upon a presumed reliability of the estimation of the speech formant components, including adjusting the gain factors to boost the speech formant components more for higher reliability formant estimations than lower reliability formant estimations; and requiring a minimum clearance between ones of the speech formant components.

2. The method according to claim 1, wherein the speech formant components are estimated based on finding spectral peaks using a linear predictive coding filter.

3. The method according to claim 1, wherein the speech formant components are estimated based on infinite impulse response smoothing of the spectral signals using a plurality of different smoothing constants.

4. The method according to claim 1, wherein the gain factors are based on shaped windows concentrated on frequency regions corresponding to the speech formant components.

5. The method according to claim 4, wherein the shaped windows are dynamically adjusted as a function of a corresponding phoneme associated with the speech signal component.

6. The method according to claim 4, wherein the shaped windows are dynamically adjusted as a function of a signal to noise ratio of the microphone signal.

7. The method according to claim 1, wherein the gain factors are applied to underestimate the noise component so as to reduce speech distortion in formant regions of the spectra signals.

8. The method according to claim 1, further comprising:

combining the gain factors with one or more noise suppression coefficients to increase broadband signal to noise ratio.

9. The method according to claim 1, further comprising:

outputting the formant enhanced spectra signals to at least one of a mobile telephony application and a speech recognition application.

10. The method according to claim 1, wherein local maxima are determined by finding zeros of a derivative of the spectra signals after smoothing.

11. The method according to claim 1, further including applying the one or more dynamically adjusted gain factors at a substantial center of the respective speech formant components.

12. The method according to claim 1, wherein the speech signal component comprises non-whispered speech.

13. A speech signal processing system comprising:

a speech signal input for receiving a microphone signal having a speech signal component and a noise component;

a signal pre-processor for transforming the microphone signal into a frequency domain set of short term spectra signals;

a formant estimating module for estimating speech formant components within the spectra signals based on detecting regions of high energy density in the spectra signals; and a formant enhancement module for applying one or more dynamically adjusted gain factors to the spectra signals to enhance the speech formant components only during voiced speech phonemes and on the speech formant components having signal-to-noise ratio above a threshold and for adjusting the gain factors around a center frequency of the speech formant components based upon a presumed reliability of the estimation of the speech formant components, wherein the gain factors are adjusted to boost the speech formant components more for higher reliability formant estimations than lower reliability formant estimations, and wherein there is a minimum clearance between ones of the speech formant components.

14. The system according to claim 13, wherein the formant estimating module estimates the speech formant components based on finding spectral peaks in a linear predictive coding filter.

15. The system according to claim 13, wherein the formant estimating module estimates the speech formant components based on infinite impulse response smoothing of the spectral signals using a plurality of different smoothing constants.

16. The system according to claim 13, wherein the gain factors are based on shaped windows concentrated on frequency regions corresponding to the speech formant components.

17. The system according to claim 16, the formant enhancement module dynamically adjusts the shaped windows as a function of a corresponding phoneme associated with the speech signal component.

18. The system according to claim 16, wherein the formant enhancement module dynamically adjusts the shaped windows as a function of a signal to noise ratio of the microphone signal.

19. The system according to claim 13, wherein the formant enhancement module applies the gain factors to underestimate the noise component so as to reduce speech distortion in formant regions of the spectra signals.

20. The system according to claim 13, wherein the formant enhancement module further combines the gain factors with one or more noise suppression coefficients to increase broadband signal to noise ratio.

21. The system according to claim 13, further comprising:

a processing output for providing the formant enhanced spectra signals to at least one of a mobile telephony application and a speech recognition application.

* * * * *